United States Patent [19]

Black

[11] Patent Number: 4,637,533

[45] Date of Patent: Jan. 20, 1987

[54] FOOT WEAR DRESSING AID

[76] Inventor: Maurice Black, 2412 S. Washington Ave., Saginaw, Mich. 48601

[21] Appl. No.: 797,038

[22] Filed: Nov. 12, 1985

[51] Int. Cl.[4] ..... A47G 25/90

[52] U.S. Cl. ..... 223/112; 223/118; D2/642

[58] Field of Search ..... 223/111, 112, 113, 114, 223/115, 116, 117, 118, 119; D2/378.2

[56] References Cited

U.S. PATENT DOCUMENTS

| | | | |
|---|---|---|---|
| D. 251,877 | 5/1979 | Fonner | D2/378.2 |
| 594,894 | 12/1897 | Nylander | 223/118 |
| 990,283 | 4/1911 | Merrow | 223/118 |
| 1,781,748 | 11/1930 | Chapper et al. | 223/118 |
| 2,939,618 | 6/1960 | Mangels | 223/113 |
| 3,310,209 | 3/1967 | Clauss | 223/111 |
| 3,452,907 | 7/1969 | MacLauchlan | 223/111 |
| 3,883,052 | 5/1975 | Wilson | 223/111 |
| 4,066,194 | 1/1978 | Leland | 223/111 |

FOREIGN PATENT DOCUMENTS

| | | | |
|---|---|---|---|
| 2340708 | 10/1977 | France | 223/112 |
| 534361 | 3/1941 | United Kingdom | 223/114 |
| 814426 | 6/1959 | United Kingdom | 223/118 |

*Primary Examiner*—Werner H. Schroeder
*Assistant Examiner*—Andrew M. Falik
*Attorney, Agent, or Firm*—Learman & McCulloch

[57] ABSTRACT

A device for assisting a handicapped person in donning and removing an article of hosiery comprising a support of such size as to be accommodated in the article of hosiery, a handle for manipulating the support, and a flexible strap coupling the support to the handle. The support has laterally extending projections between which portions of the article of hosiery may be positioned to resist separation of the support and the hosiery.

17 Claims, 5 Drawing Figures

FOOT WEAR DRESSING AID

This invention relates to a device that is especially adapted for use in aiding a person to don and remove hosiery.

BACKGROUND OF THE INVENTION

Many persons suffer from back, hip, or knee disorders which make difficult if not impossible the donning of hosiery without assistance. Several kinds of mechanical devices have been proposed heretofore and which are designed to provide assistance of such nature that a person who is unable to don hosiery without help need not require the services of another person. Typical of such devices are those disclosed in U.S. Pat. Nos. 3,310,209; 3,401,856; 3,452,907; 3,853,252; and 4,066,194. Some of such devices are more effective than others, but all of them have certain drawbacks such as maintaining an article of hosiery on the device during and following insertion of a person's foot into such article. Another difficulty encountered with previously known devices of the kind referred to is that of immobilizing the device during application of the hosiery to the person's foot and leg. Apparatus constructed in accordance with the invention overcomes these disadvantages.

SUMMARY OF THE INVENTION

A device constructed in accordance with the invention and adapted for use in assisting a handicapped person in donning an article of hoisiery comprises a trough-like support having a bottom and upstanding sides, the sides of the support being such as to enable a person's foot to be accommodated between the sides and the foot and the device partially to be accommodated within the sock or stocking. The device also includes a handle that is coupled to the support by a flexible strap which enables the support and the handle to assume relative positions in which the support and the handle are substantially normal to one another and with both the support and one end of the handle on a floor or other surface. In this manner the support can bind a portion of the article of hosiery between the support and the floor and enable the handle to secure the support against movement.

The flexibility of the coupling strap enables the support to move from a position substantially normal to the handle to a position in which the support and the handle extend substantially in prolongation to one another, thereby facilitating movement of an article of hosiery past a person's heel and upwardly along the leg. The flexibility of the coupling member also enables the support to be moved to a position in which it substantially parallels the handle, thereby enabling the support and handle to assume a compact, folded condition for storage or transport.

The outer surfaces of the sides of the support are provided with hosiery gripping means which resist inadvertent withdrawal of the support from the article of hosiery as the latter is drawn over the instep, around the heel, and upwardly along the person's leg.

THE DRAWINGS

A device constructed in accordance with a preferred embodiment of the invention is illustrated in the accompanying drawings wherein.

DETAILED DESCRIPTION

Figure 1:
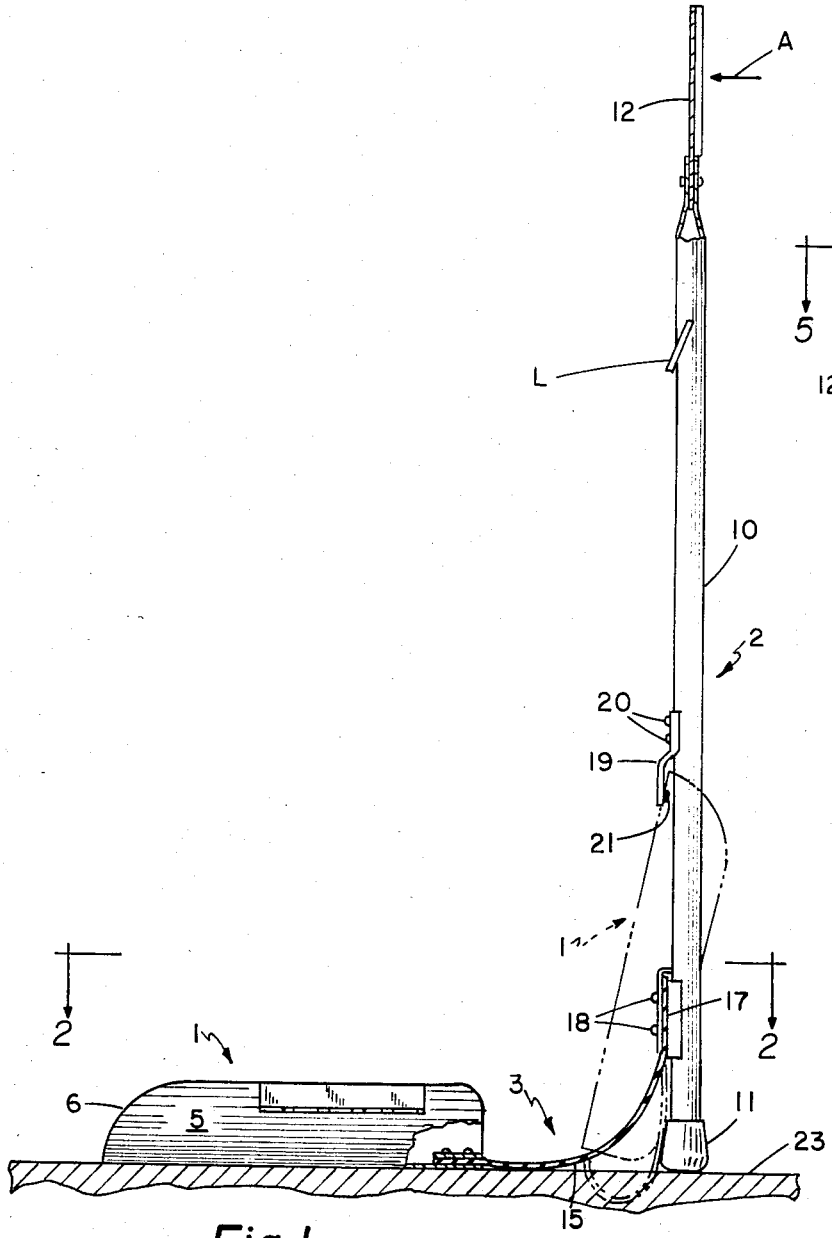
FIG. 1 is a view partly in side elevation and partly in section of the device.
Figure 4:
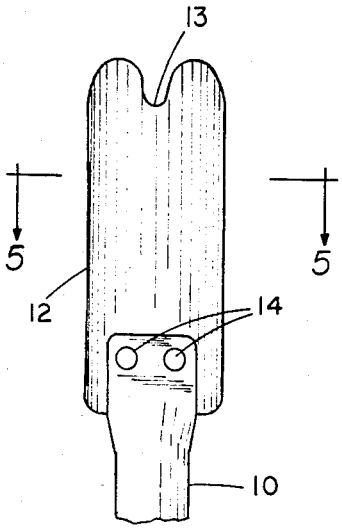
FIG. 4 is a fragmentary, greatly enlarged elevational view taken in the direction of the arrow A in FIG. 1
Figure 5:
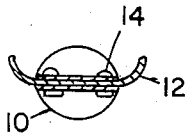
FIG. 5 is a sectional view taken on the line 5—5 of FIG. 4.
Figure 2:
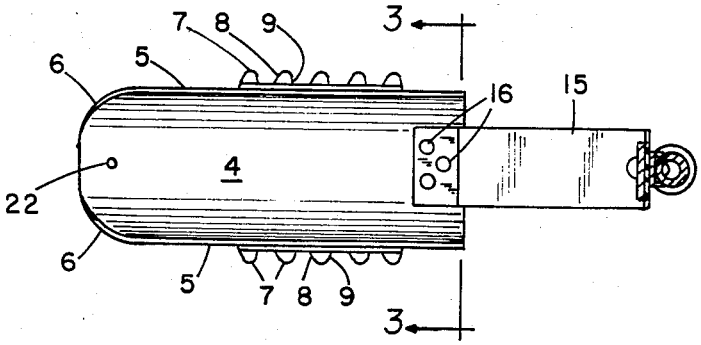
FIG. 2 is a sectional view taken on the line 2—2 of FIG. 1.
Figure 3:
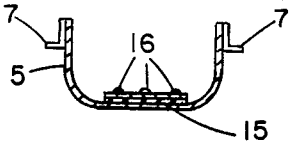
FIG. 3 is a sectional view taken on the line 3—3 of FIG. 2.

A dressing aid for assisting a person in donning an article of hosiery comprises a support 1, a handle 2, and a flexible coupling 3 joining the support and handle to one another. The support 1 comprises a trough-like member formed of metal, plastic, or other suitable material and having a bottom joining a pair of upstanding, spaced, substantially parallel sides 5 which terminate at their forward ends in smoothly rounded surfaces 6. The trough is open at both of its ends. To the outboard surface of each side 5 and between the upper and lower edqes thereof is fixed a series of hosiery gripping projections or teeth 7 each of which is spaced from one another longitudinally of the support and each of which has a forward, sloping surface and a rear surface 9. The rear surface 9 is considerably more abrupt than the forward surface 8 for a purpose presently to be explained.

The handle 2 comprises an elongate rod formed of metal, plastic, or any other suitable material and terminates at one end in a rubber or rubbery anti-skid foot 11. At its other end the rod 10 is fitted with a concavo-convex shoehorn 12 having an axially extending slot 13 at its free end. The shoehorn may be fixed to the handle 10 by suitable means such as rivets 14.

The rod 10 may be equipped with a swingable loop L to enable the device to be suspended from a hook or the like (not shown). Alternatively, the shoehorn 12 could be perforated for the same purpose.

The coupling member 3 comprises a strap 15 of relatively stiff, but flexible, material such as fiberglass, although any suitable material may be used. The strap 15 is joined at one end by rivets 16 or the like to the rear end of the support 1 and the opposite end of the strap 15 is joined to a mounting bracket 17 fixed by rivets 18 to the handle rod 10. The strap is joined to the rod at a zone spaced from the foot 11 thereby enabling the free end of the latter to be freely exposed.

The rod 10 of the handle also preferably is fitted with a retainer 19 fixed to the rod by screws 20 and having a portion thereof spaced from the rod a distance sufficient to enable the forward end of the bottom of the support 1 to be introduced between the rod and the retainer 19. A detent 21 carried by the retainer 19 may be accommodated in an opening 22 formed adjacent the forward end of the support bottom 4.

The coupling strap 15 should be of sufficient flexibility as to enable the support 1 to occupy a position substantially normal to the handle 2, as is shown in full lines in FIG. 1, but the strap should be sufficiently stiff as to prevent twisting thereof, thereby ensuring one to maintain control via the handle of the positions of the support. In addition, the flexibility of the coupling strap should be such as to enable the support 1 to swing downwardly upon upward movement of the hand 2 to a position in which the support and handle are in substantial prolongation of one another, and to a compact, folded position as is shown in dotted lines in FIG. 1.

To condition the apparatus for operation, a sock, stocking, or other article of hosiery is stretched at its open end an amount sufficient to enable substantially the entire support member 1 to be accommodated within the article. The sloping surfaces 8 of the teeth 7 assist in stretching the article, but do not materially impede movement of the support into the article. Preferably, the rounded forward end 6 of the support abuts the inside of the toe of the article of hosiery and the article extends rearwardly along the support a distance sufficient to cover all of the gripping teeth 7. The support 1 then may be placed upon a floor 23 or any other suitable, flat surface with the article of hosiery interposed between the bottom 4 of the support and the surface 23. The coupling strap 15 is of such length as to enable the foot of the person to be interposed between the rear end of the support 1 and the handle 2 and thrust into the support and that part of the sock or stocking accommodating the support. As the foot enters the support, there is a tendency for the support to move forwardly. This tendency is overcome by the application of downward force on the handle 2 so as to engage the foot 11 firmly against the surface 23 while the support simultaneously engages the same surface.

As the person's foot enters the support and the article of hosiery, the instep will tend to lift that part of the article of hosiery which overlies the support. This results in further stretching of the article of hosiery and causes the sides of the latter to enter the spaces between adjacent teeth 7. The abruptness of the rear surfaces 9 of the teeth quite effectively will resist relative movement of the support 1 and the sock or stocking.

As movement of the person's foot proceeds forwardly further into the support 1, and the person's toes abut the inner surface of the toe of the sock or stocking, the handle 2 may be raised off the surface 23, thereby enabling the support 1 to be withdrawn from under the person's foot and outwardly through the open end of the article of hosiery. This movement of the support relative to the sock or stocking will enable the latter to be drawn upwardly along the person's leg to the point at which it may be grasped by the person's hands. The support then may be withdrawn from the hosiery article. Although the gripping teeth 7 resist withdrawal of the support from the sock or stocking the surfaces 9 are not so abrupt as to prevent such withdrawal.

The notch or slot 13 formed in the shoehorn 12 enables the shoehorn to function not only to assist in the donning of shoes, but also facilitates removal of shoes and articles of hosiery. That is, the upper edge of a shoe or article of hosiery may be fitted into the slot 13 of the shoehorn, following which the handle 2 may be used to push the shoe or the article of hosiery off a person's foot.

When the device is not in use, the support 1 may be swung to the dotted line position shown in FIG. 1 with the sides 5 of the support embracing the handle rod 10. The free end of the support may be fitted between the handle rod and the retainer 21 and maintained in such position until the use of the device again is required.

The disclosed embodiment is representative of a presently preferred form of the invention, but is intended to be illustrative rather than definitive thereof. The invention is defined in the claims.

I claim:

1. A device for assisting a person in donning an article of hosiery, said device comprising an open top, trough-like support member open at both ends and having a bottom and a pair of spaced apart sides upstanding from said bottom; an elongate, rigid handle having opposite ends; and flexible coupling means joining one end of said support member to said handle adjacent one end thereof, the spacing between said sides enabling the accommodation therebetween of a foot of said person, and the spacing between and the height of said sides enabling the opposite end of said support member to be accommodated in said article of hosiery, the flexibility and the length of said coupling means enabling said support member and said handle selectively to occupy positions in which they substantially parallel one another, extend in substantial prolongation of one another, or are in a position substantially normal to one another and in which latter position the bottom of said support member and said one end of said handle simultaneously may engage a flat surface.

2. A device according to claim 1 wherein said coupling means is joined to said handle at a zone spaced from said one end thereof.

3. A device according to claim 1 including an plurality of hosiery gripping members carried by each of said sides between their upper and lower edges outboard of said support member and spaced longitudinally of the latter.

4. The device according to claim 3 wherein said gripping means comprises a series of teeth.

5. The device according to claim 5 wherein each of said teeth has a relatively abrupt surface facing in the direction of said coupling means and a relatively less abrupt surface facing in the opposite direction.

6. The device according to claim 1 including a anti-skid member carried by said handle at said one end thereof.

7. The device according to claim 1 including means reacting between said handle and said support for releasably retaining the latter in said substantially parallel position.

8. The device according to claim 1 wherein said handle terminates at its opposite end in a shoehorn.

9. The device according to claim 8 wherein said shoe horn has an axially extending slot therein.

10. A device for assisting a person in donning an article of hosiery, said device comprising an open top, channel-shaped support open at its opposite ends and having upstanding sides spaced from one another a distance to enable a foot of a person to be accommodated therebetween; an elongate, rigid handle having opposite ends; and a flexible coupling strap joining one end of said support to said handle between its ends and adjacent one end thereof, the flexibility of said strap enabling said support and said handle to occupy positions in which they are substantially normal to each other or extend in substantial prolongation of one another, the spacing between said sides and the height thereof enabling said article of hosiery to accommodate at least a portion of said support at that end of the latter remote from said strap.

11. A device according to claim 10 including hosiery gripping means carried by each of said sides outboard of said support.

12. A device according to claim 11 wherein said gripping means is carried by said sides between their upper and lower edges.

13. The device according to claim 12 wherein said gripping means comprises a series of teeth spaced from each other longitudinally of the associated side.

14. The device according to claim 13 wherein each of said teeth has a relatively abrupt surface facing in the direction of said coupling means and relatively less abrupt surface facing in the opposite direction.

15. A device for assisting a person in donning an article of hosiery, said device comprising an open top, trough-like support member open at both ends and having a bottom and a pair of spaced apart sides upstanding from said bottom, the spacing between said sides enabling the accommodation therebetween of a foot of said person and the spacing between and the height of said sides enabling one end of said support member to be accommodated in said article of hosiery; a plurality of hosiery gripping members carried by each of said sides between its upper and lower edges being spaced longitudinally of said support member, said gripping members projecting laterally of and outward of said support member; and flexible coupling means connected to said support member at its other end wherein said gripping means comprises a series of teeth, wherein each of said teeth has a relatively abrupt surface facing in the direction of said coupling means and a relatively less abrupt surface in the opposite direction.

16. The device according to claim 15 wherein said coupling means is secured at that end remote from said support member to and between the ends of a rigid, elongate handle.

17. The device according to claim 16 wherein said coupling means is secured to said handle closer to one end thereof than to the other, and wherein said one end of said handle has an anti-skid member at said one end thereof.

* * * * *